US009339075B2

(12) United States Patent
Ratliff

(10) Patent No.: US 9,339,075 B2
(45) Date of Patent: May 17, 2016

(54) CAP HEARING PROTECTION SYSTEM

(71) Applicant: Larry D. Ratliff, Lexington, KY (US)

(72) Inventor: Larry D. Ratliff, Lexington, KY (US)

( * ) Notice: Subject to any disclaimer, the term of this patent is extended or adjusted under 35 U.S.C. 154(b) by 0 days.

(21) Appl. No.: 14/451,121

(22) Filed: Aug. 4, 2014

(65) Prior Publication Data

US 2015/0041243 A1 Feb. 12, 2015

Related U.S. Application Data

(60) Provisional application No. 61/864,046, filed on Aug. 9, 2013.

(51) Int. Cl.
*A42B 3/16* (2006.01)

(52) U.S. Cl.
CPC ..... *A42B 3/166* (2013.01); *Y10T 29/4984* (2015.01)

(58) Field of Classification Search
CPC ..... A42B 3/166; A42B 1/22
USPC ..... 181/129; 2/10, 209, 208, 195.5, 423
See application file for complete search history.

(56) References Cited

U.S. PATENT DOCUMENTS 2,149,121 A * 2/1939 Kronenberger ..... A42B 1/068 2/209
2,442,825 A * 6/1948 Rabushka ..... A42B 1/068 2/195.5
2,444,251 A * 6/1948 Goldman ..... A42B 1/068 2/209
2,572,746 A * 10/1951 Mougel ..... 2/209
2,640,199 A * 6/1953 Funk ..... A42B 1/068 2/195.5
2,844,820 A * 7/1958 Austin et al. ..... 2/423
3,193,841 A * 7/1965 Haluska ..... 2/423
3,197,785 A * 8/1965 Simpson et al. ..... 2/423
3,430,261 A * 3/1969 Benner ..... 2/423
3,461,463 A * 8/1969 Beguin ..... 2/423
3,728,741 A * 4/1973 Lepor ..... A61F 11/14 2/209
3,845,505 A * 11/1974 Davison et al. ..... 2/209
3,864,756 A * 2/1975 Desimone ..... 2/423
3,946,466 A * 3/1976 Sakai ..... 24/568
4,069,512 A * 1/1978 Palmaer ..... 2/209
4,104,743 A * 8/1978 Bottger ..... 2/423
4,222,123 A * 9/1980 Hellberg ..... 2/10
4,347,631 A * 9/1982 Newcomb ..... 2/423
4,391,000 A * 7/1983 Lonnstedt ..... 2/423
4,856,089 A * 8/1989 Horton ..... 455/351
4,944,361 A * 7/1990 Lindgren et al. ..... 181/129
5,546,610 A * 8/1996 Herzig et al. ..... 2/422
6,067,658 A * 5/2000 Cho ..... A42C 5/02 2/181
6,115,846 A * 9/2000 Truesdale ..... A42B 3/042 2/171.3
8,166,575 B2 * 5/2012 Haselmayer ..... 2/422
2004/0199979 A1 * 10/2004 Ngan ..... A42C 5/02 2/195.1
2004/0218776 A1 * 11/2004 Rolla ..... 381/374
2005/0028250 A1 * 2/2005 Zaic ..... 2/209
2008/0184465 A1 * 8/2008 Chang ..... 2/423
2010/0281605 A1 * 11/2010 Pereira ..... 2/422
2011/0113537 A1 * 5/2011 Peng ..... 2/423
2012/0297521 A1 * 11/2012 Shirai ..... A41F 1/008 2/183
2013/0219598 A1 * 8/2013 Pfanner et al. ..... 2/423

* cited by examiner

*Primary Examiner* — Jeremy Luks

(57) ABSTRACT

A cap hearing protection system that includes a cap; a band secured within an interior of the cap; first and second rotating arms positioned on either side of the cap and pivotally connected to the band; and a respective hearing protection means mounted to each of the rotating arms.

2 Claims, 9 Drawing Sheets

Fig. 14a
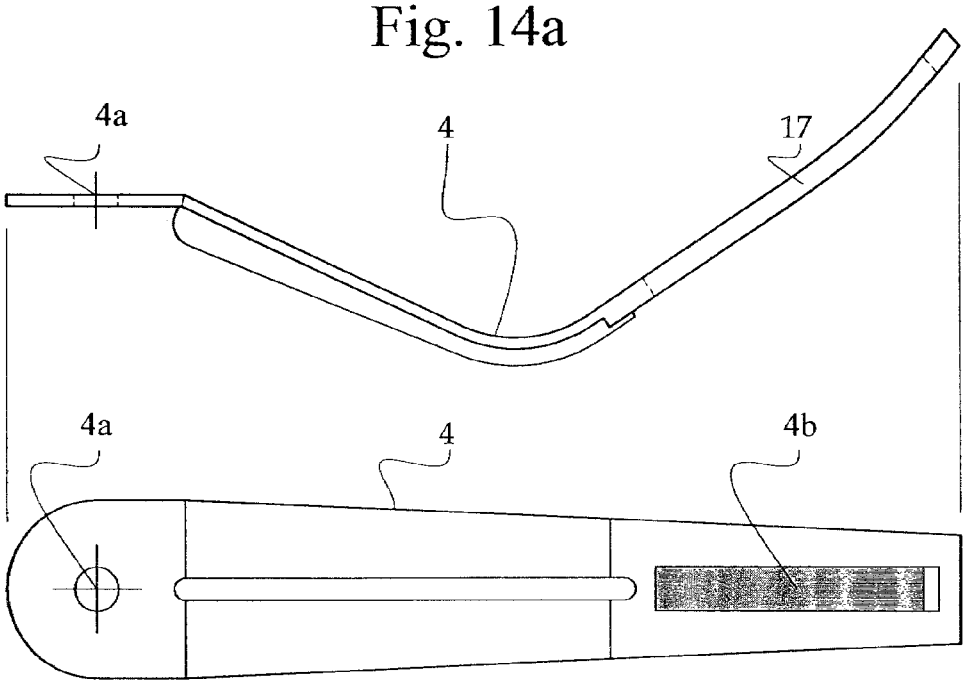
Fig. 14b
Fig. 15a
Fig. 15c
Fig. 15e
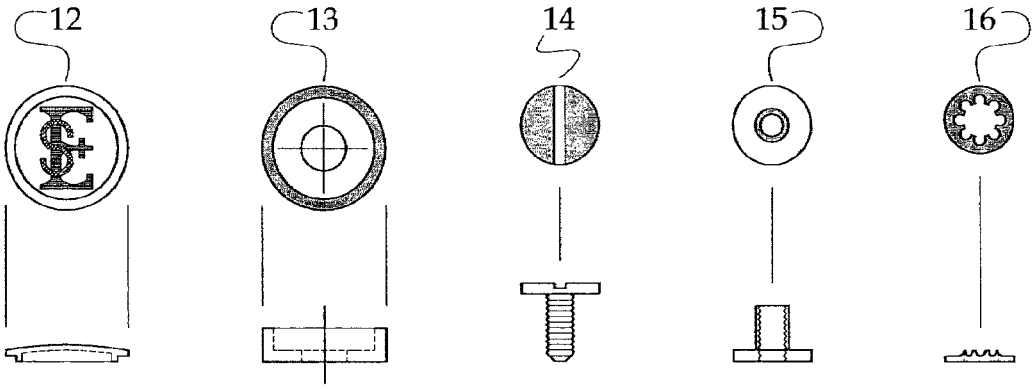
Fig. 15b
Fig. 15d

CAP HEARING PROTECTION SYSTEM

RELATED APPLICATIONS

The present disclosure claims priority to U.S. Provisional Patent Application Ser. No. 61/864,046 entitled "Cap Hearing Protection System" filed Aug. 9, 2013, the disclosure of which is incorporated herein by reference, in its entirety.

BACKGROUND

The present disclosure relates to safety equipment and, more particularly, to hearing protection.

Noise induced hearing loss (NIHL). This type of hearing loss is usually painless, progressive and always permanent but can also be 100 percent preventable. The proper usage of ear protection can prevent damage from both, impulse and continuous sound. Noise-induced hearing loss (NIHL) is a problem that affects millions of people within the United States and across the entire world each and every year. This type of hearing loss is due to exposure to either a sudden loud noise or exposure to loud noises for a period of time.

OSHA hearing protection directives. Per OSHA the following permissible noise vs. maximum time exposures have been established: 90 dB=8 hours per day, 92 dB=6 hours per day, 95 dB=4 hours per day, 97 dB=3 hours per day, 100 dB=2 hours per day, 102 dB=1½ hours per day, 105 dB=1 hour per day, 110 dB=½ hour per day, 115 dB=¼ hour or less per day. People should not be exposed to noise levels in excess of 115 dB for any length of time without hearing protection.

Noise associated with various items expressed in dB rating (approximate): hand drill 98 dB, power mower 107 dB (at 3'), snowmobile 100 dB, motor cycle 100 dB, sand blasting 115 dB, pneumatic riveter 125 dB (at 4'), jet engine 140 dB (at 100'), aircraft takeoff 180 dB, artillery fire 140 dB, riveter 120 dB, chipper 120 dB, diesel engine room 120 dB, punch press 110 dB, turbo jet 160 dB, compressor 120 dB, hand held circular saw 115 (at 3'), band saw 95 dB, grinder 100 dB, router 100 dB, welding machine 100 dB, impact wrench 105 dB, diesel generator 110 dB, pneumatic drill 130, jack hammer 130, fighter plane 140 dB, howitzer cannon 175 dB, power tools 110 dB, tractor without cab 120 dB, chain saw 110 dB, leaf blower 110 dB, bull dozer 105 dB, hammer drill 113 dB, .30-30 rifle 156 dB, .357 revolver 165 dB, 9 mm pistol 160 dB, .45 ACP pistol 157 dB, .22 pistol 152 dB, magnum rifle with muzzle brake 170 dB, .30-06 rifle 165 dB, .223 rifle 155 dB, .22 rifle 130 dB, .410 shotgun 150 dB, 12 gauge shotgun 165 dB. The aforementioned listing of items, with associated dB ratings, is provided so as to allow understanding in how noise induced hearing loss (NIHL) potentially affects numerous types of people.

A partial listing of those at risk for noise induced hearing loss (NIHL) includes but is not limited to: All of the many households which perform yard maintenance tasks, household projects and the like. Farmers are affected on a daily basis while performing many routine tasks. It affects sportsmen in the field (virtually all hunters do not utilize hearing protection for reason of inconvenience) and shooters at the range. It affects factory workers within industry and construction personnel on a daily basis. Military personnel constitute another group of individuals who are constantly in varied situations which expose participants to high noise levels (personnel, while assumed to currently be provided hearing protection, could also derive benefits regarding a vastly improved, effective and convenient sound attenuation system, to be utilized in "non-helmet" environments).

Within this country alone, per U.S. Census statistics, there are approximately 115 million households. In considering hunters and range shooters, per NRA disclosure, there are approximately 70 to 80 million gun owners with approximately 300 million guns in the United States. Per OSHA statistics, there are approximately 30 million people in the United States who are occupationally exposed to hazardous noise. The aforementioned data provides a listing of three large hearing loss exposure categories, with associated quantitative values, as a means to illustrate the multitude of people exposed to unsafe noise. This information is provided as a general reference, for use in understanding the magnitude of people who are potentially at risk. It should not be considered all inclusive, and does not represent the many other groups of people also at risk but not delineated, both inside and outside of the United States.

To date only "hard" hats have been provided with a system which utilizes an ear muff style of hearing protection. The ear muff hearing protection system is clipped to the "hard" hat by utilization of existing slots located on the sides of said hat. This system is removable in nature and available for use with "hard" hats only. This system poses the same negative aspects associated with the usage of all hard hats. Many individuals who use hard hats do so only because of the nature of their job (from a safety perspective) or simply because they are told to. Hard hats get in the way at times, are cumbersome in nature and in general, when compared to caps, not desirable for general usage (when protection of head is not required).

To date the only cap hearing protection system available incorporates retractable ear plugs with its design. This design utilizes a cap, with sewn onto sides of cap, cloth pouches, which house a retractable ear plug hearing protection system. Pouches are located near adjustable head band at rear of cap. The rearward portion of the pouch end is open to allow for actuation of corded retractable ear plugs. Upon activation the user pulls plug to a desired length and inserts plug into ear canal. Upon discontinuation of use, the user removes plug from ear and pulls on plug to activate the means of retraction. This system poses the same negative aspects associated with all ear plug hearing protection systems such as: difficult (at times) to affect seal, hygiene issues and general discomfort associated with ear plug systems.

Several methods of personal hearing protection currently exist which can be utilized with a cap. All of these systems are not attached to cap. Several of the more popular "stand alone" hearing protections systems include:

- "expandable/disposable ear plugs". This type of system consists of soft, foam like inserts, that when placed in ear, seal the canal opening. Plugs are difficult to keep up with and easily lost. This type of plug needs to be replaced frequently to prevent the potential of ear infection due to soiled plugs. Units are also uncomfortable to use and difficult (at times) to affect seal.
- "pre-molded ear plugs". This type of plug is comprised of rubber, plastic, wax or silicone. Not as compressive as foam. User must ensure correct size is selected to ensure proper fit. Plugs are difficult to keep up with and easily lost. This type of ear plug requires frequent cleaning to prevent the potential of ear infection due to soiled plugs. Units are also uncomfortable to use and difficult (at times) to affect seal.
- "canal caps". Canal caps basically consist of ear plugs attached to a rubber or metal band which extends around the users head. When not in use, units can be placed around users neck, or placed somewhere remote from user until needed for use. Canal caps must be fit properly to size of individuals ear canal to affect a proper seal.

Positioning of unit around neck during periods of non-use can cause discomfort to user (all methods of placement in non-usage mode present various degrees of either discomfort or inconvenience to the user). As with pre-molded ear plugs, this system requires cleaning to prevent the potential of ear infection due to soiled plugs. Units are also uncomfortable to use and at times difficult to affect a proper seal.

"custom ear plugs". Are custom made from impressions of individuals ears. Many styles are available. All methods of placement in non-usage mode present inconvenience to the user. This style of ear plug also requires frequent cleaning to prevent the potential of ear infection due to soiled plugs. Units, while custom fitted to users ear, can also be uncomfortable to use.

"Earmuffs" (hearing protective). Hearing protective earmuffs are a completely different type of hearing protection when compared to "plug-type" units. Earmuffs cover the entire outer ear, creating a hearing protective seal. The muffs are connected by a metal or plastic band that wraps around users head which in turn keeps the muffs in place over the individuals ears. Some earmuff systems utilize electronic noise reduction technology to further reduce sound levels when compared to the basic or non-electronic systems. When this type of system is not being utilized, the user either places unit around neck, places unit on bench, table or something of the like or places unit on a belt mounted clip (another invention currently available on the market). All methods of placement in the non-utilization mode present various degrees of either discomfort or inconvenience.

Comfort and convenience are important when considering the selection of a means of hearing protection. If a particular type of hearing protection system is difficult to use, requires ongoing maintenance or presents discomfort or inconvenience in usage, the user is potentially less likely to utilize, or keep said system properly maintained. The ease of placing and removing the device, along with comfort, as well as environmental factors such as dirt and general soiling, present factors worth consideration in the selection of a hearing protection system.

The aforementioned "stand alone" hearing protection systems pose various degrees of problems in and by themselves. Other problems manifest themselves with "stand alone" hearing protection systems, when used in conjunction with a cap, if used in their present "stand alone" form.

Accordingly while various forms of hearing protection currently exist, there is an unmet need for the development of an effective, yet comfortable and convenient hearing protection system, that can be utilized while wearing a cap. The disclosed invention provides a solution to this need.

SUMMARY

Embodiments of the present invention relate to a cap hearing protection system that includes a cap; a band secured within an interior of the cap; first and second rotating arms positioned on either side of the cap and pivotally connected to the band; and a respective hearing protection means mounted to each of the rotating arms.

Another embodiment of the present invention relates to a method of constructing a cap hearing protection system. The method includes securing a flexible band inside an interior of a cap; pivotally connecting first and second rotatable arms to the flexible band, wherein the first and second arms are located on opposite sides of the cap; and mounting a respective hearing protection means to each of the first and second rotatable arms.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Various aspects of a embodiments of the disclosure are illustrated by way of example, and not by way of limitation, in the accompanying drawings, wherein:

FIG. 14*a* is a first view of one of the rotating arms of the exemplary cap hearing protection system of FIG. 1;

FIG. 14*b* is an alternate view of the rotating arm of FIG. 14*a;*

FIG. 15*a* includes views of a cover cap, one of the components used to connect one of the rotating arms of the exemplary cap hearing protection system of FIG. 1 to the cap;

FIG. 15*b* includes views of a concealment well, one of the components used to connect one of the rotating arms of the exemplary cap hearing protection system of FIG. 1 to the cap;

FIG. 15*c* includes views of a binder post screw, one of the components used to connect one of the rotating arms of the exemplary cap hearing protection system of FIG. 1 to the cap;

FIG. 15*d* includes views of a binder post, one of the components used to connect one of the rotating arms of the exemplary cap hearing protection system of FIG. 1 to the cap;

FIG. 15*e* includes views of a locking washer, one of the components used to connect one of the rotating arms of the exemplary cap hearing protection system of FIG. 1 to the cap;

DETAILED DESCRIPTION OF THE PREFERRED EMBODIMENTS

Figure 1:
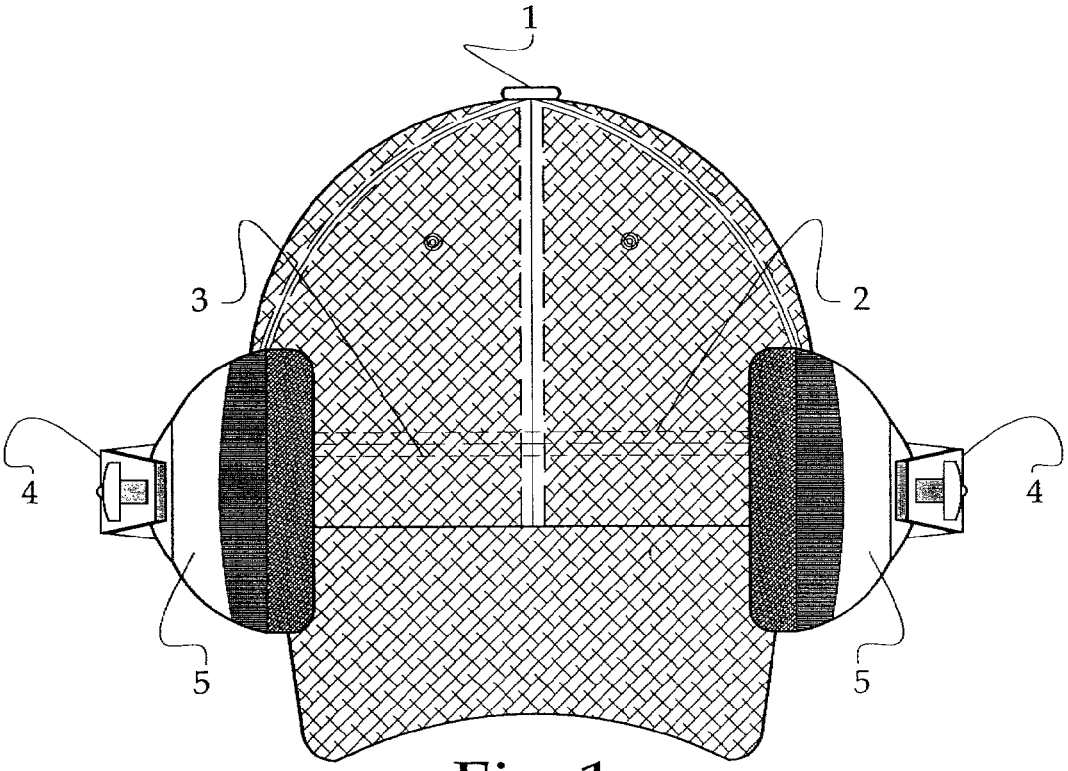
FIG. 1 is a front view of an exemplary cap hearing protection system made in accordance with the present invention and in the non-usage (or storage) position.
Figure 2:
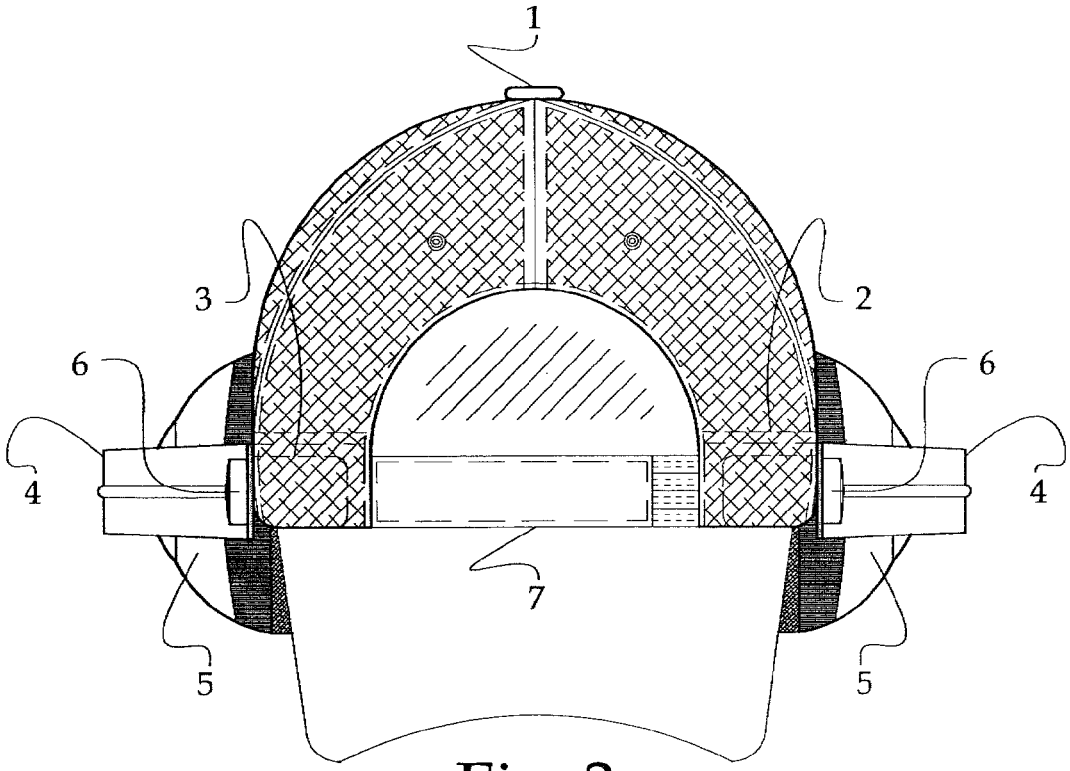
FIG. 2 is a rear view of the exemplary cap hearing protection system of FIG. 1.
Figure 3:
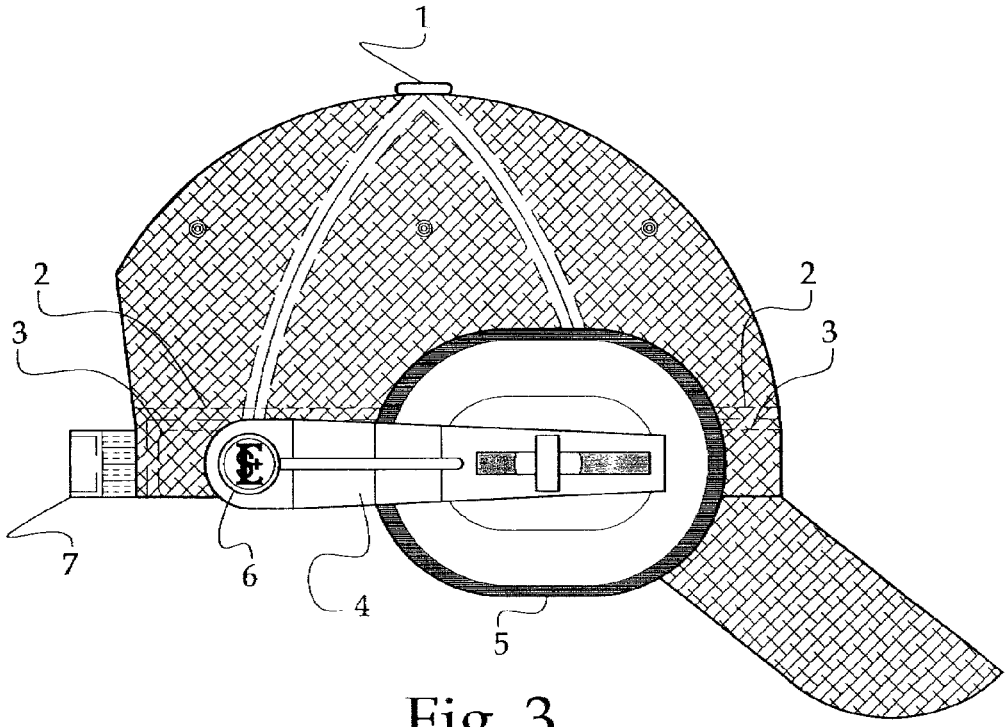
FIG. 3 is a left side view of the exemplary cap hearing protection system of FIG. 1.
Figure 4:
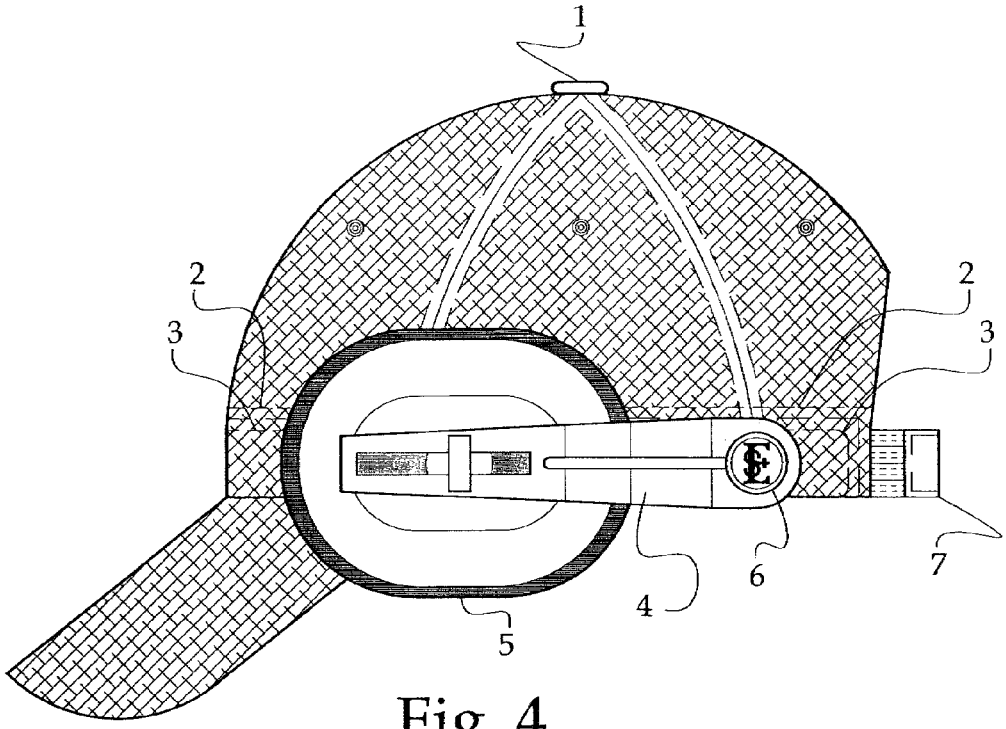
FIG. 4 is a right side view of the exemplary cap hearing protection system of FIG. 1.
Figure 5:
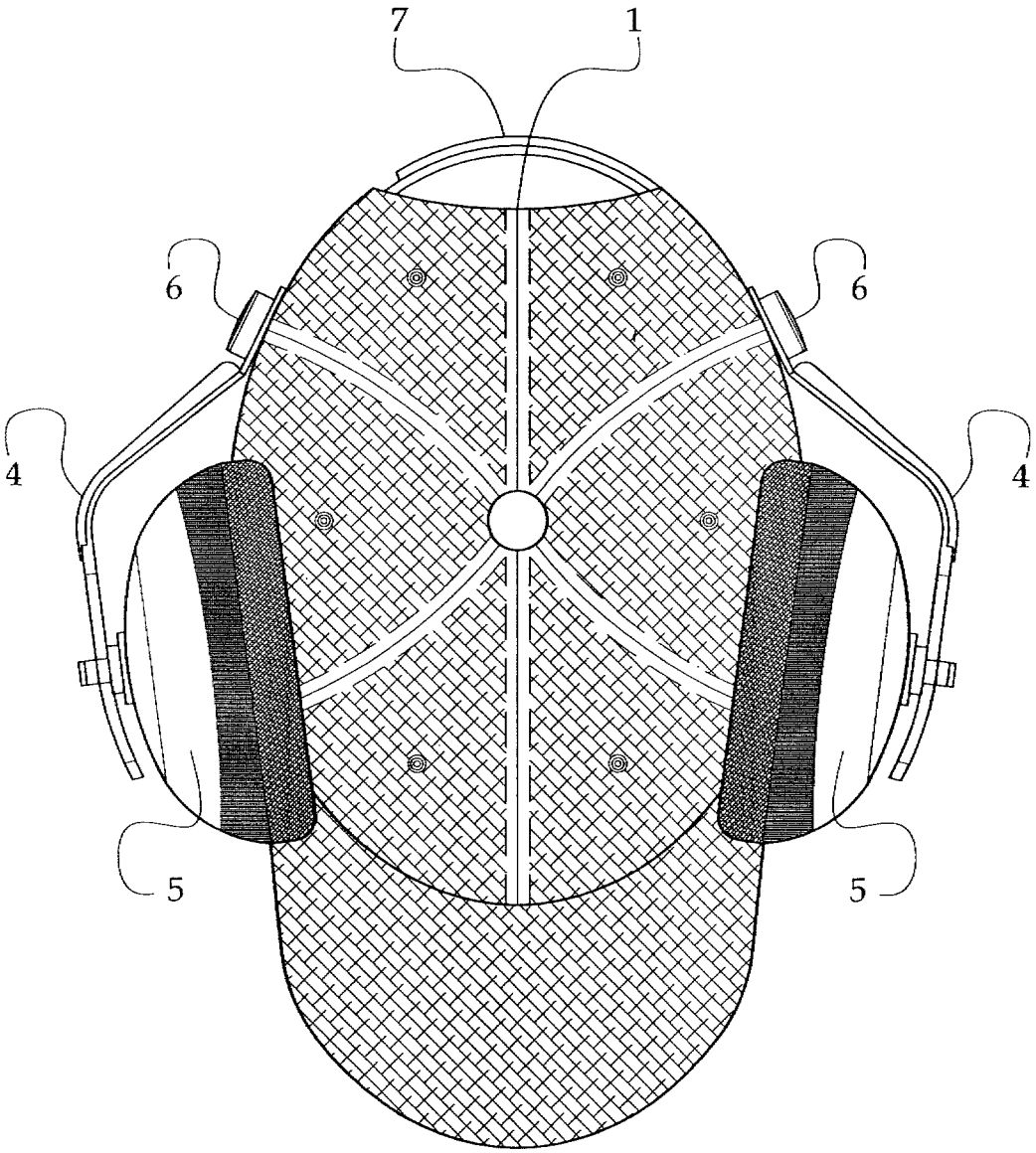
FIG. 5 is a top view of the exemplary cap hearing protection system of FIG. 1.
Figure 6:
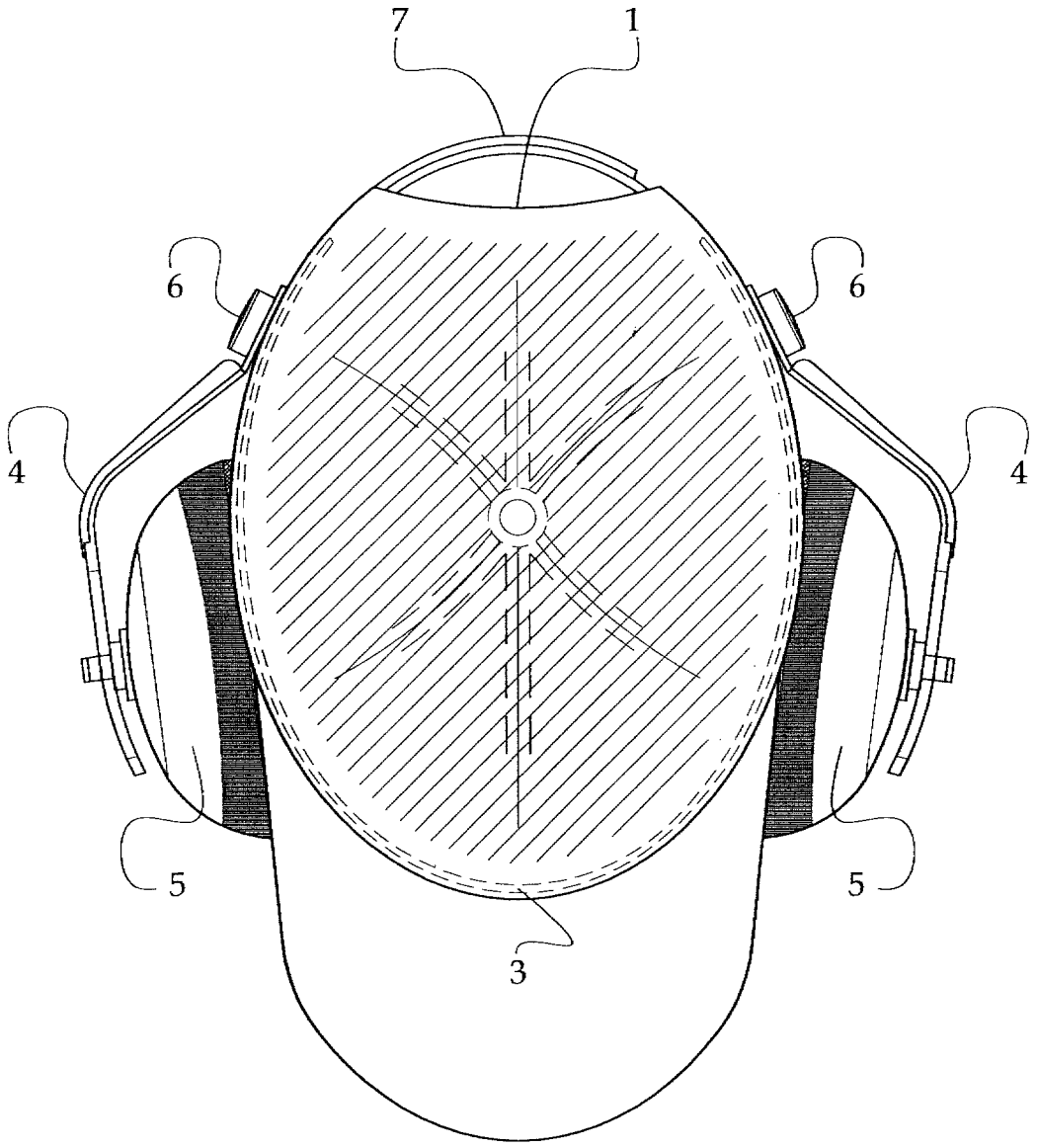
FIG. 6 is a bottom view of the exemplary cap hearing protection system of FIG. 1.

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

One object of the present invention is to provide a basic cap (head cover), coupled with associated modifications, which is intended for use as hearing protection, in a manner which resolves the negative attributes associated with "prior art". The present invention provides the user a means of proper sound attenuation in a manner which is effective, comfortable to wear, easy to utilize, and essentially maintenance free. The invention, as currently disclosed, relates generally to an earmuff style of hearing protection incorporated to a common cap, such as a conventional, soft-sided baseball-style cap. The cap, while basic in nature, when combined with an "earmuff" style of hearing protection, provides comfortable, yet effective, sound attenuation which is virtually maintenance free. The disclosed invention has the capability to allow the use of various forms of earmuff style hearing protection systems, in conjunction with a "basic cap assembly". The "basic cap assembly" includes a cap, a flexible band (mounting platform) and related pivoting arms which have been affixed to cap/flexible band (mounting platform) in a manner which is to be considered not removable for all intensive reasoning, thus to be considered intrinsic to the "basic cap assembly". The allowance of incorporating various types of earmuff components, to the affixed rotating arms, allows this "basic cap assembly" to be a truly versatile unit, with value to hunters, shooters at the range, farmers, factory workers, yard maintenance workers, military personnel, and the like. Any situation where the necessity of hearing protection is required, without the use of a "hard" hat, the cap style of hearing protection will be the system of choice due to comfort, ease of usage, lack of required maintenance and flexibility.

In design of the "cap hearing protection system", a thorough review was conducted regarding all of the various forms of hearing protection currently available for use. Regarding this review, it was decided that the ear muff style of hearing protection, in a modified format, would be the hearing protective system of choice to be utilized. Comfort, effectiveness, and hygiene considerations comprised major components in this decision making process. The downfalls associated with prior art become a non-issue when utilized within the scope of the proposed invention.

The cap hearing protection system begins with the utilization of a basic cap (this cap could be a baseball style cap or any of the many other caps which are currently available or in the future become available within the market place). The basic cap shall be provided with a flexible band, which is to be secured within the caps head band. The flexible band provides the cap the ability to fit various head sizes. The flexible band, while bendable in nature, also provides the rigidity needed for use as an effective mounting platform. In one example embodiment, the flexible band can include cushioning partly or entirely along its circumference to provide additional comfort to a wearer of the cap. Rotating arms are secured to the flexible band mounting platform and cap at one end of arm, and are secured to the hearing protective ears muffs at the other end of arm. The rotating arm possesses "spring-like" qualities. The "spring-like" qualities allow the required tension for activation of ear muffs from the "at-rest" position located along the sides of cap (in non-usage state) to the active (in usage state) when in the "down" position over the users ears. The rotating arms are provided with adjustment slots (or other means of adjustment dependent upon style of hearing protective earmuff to be utilized), to allow custom positioning of earmuff in relationship to users ear, thus providing an effective seal around ear when in usage. A hearing protective earmuff is attached to this adjustable portion of the rotating arm via fastener. The pivoting action of the assembly is user friendly and allows easy engagement/disengagement of earmuffs with one hand. The cap, with associated components of assembly, is fully adjustable, so as to accommodate a variety of users and yet gives a "custom fitted feeling" which is comfortable to wear.

The disclosed invention utilizes a basic cap 1. The cap 1, in and by itself, can be any of a wide range of caps.

The cap 1 is next modified to provide a mounting hole 1*a* (See FIG. 16) to caps outer shell on each side of cap 1 (said mounting hole 1*a* does not penetrate attached cap 1 head band 2). Said mounting hole 1*a* can be reinforced in some manner such as, for example, via additional thread and or material or by the addition of an insert or the like.

Within the head band 2 of said cap 1 a relatively thin metal or plastic flexible band 3 is inserted. An example size may be a width of approximately ¾. Said flexible band 3 can extend from one end of cap 1 head band 2 to the other, basically butting into each side of the adjustable band at rear of cap 7 (the cap has the ability to fit a variety of head sizes). The flexible band 3 material has the capability to maintain a molded shape (thus conforming to various head sizes). The flexible band 3 material has the rigidity needed to provide usage as a mounting platform. The flexible band 3 material is provided with a mounting hole 3*a* on each side which corresponds to the mounting hole 1*a* located on the outer shell of the cap 1.

A binder post 15 is next introduced thru flexible band 3 extending thru outer shell of cap 1, with portion of binder post 15 protruding outboard of the cap 1 outer shell. This is typical on each side of cap 1.

The cap 1 head band 2 is sewn over the flexible band 3 insert, thus encapsulating flexible band 3 within the cap 1 head band 2 Because the cap 1 is provided by various manufacturers, the provision of additional cap head band 2 material may be beneficial in certain instances.

Next a preformed plastic or bent to shape metal rotating arm 4 is attached to the extended portion of the binder post 15. This is typical on each side of cap 1. The rotating arm 4 material can beneficially possess "spring-like" qualities. In "non-use" mode, this "spring-like" quality allows the rotating arm 4, with associated hearing protective earmuff 5, to rest securely in place at sides of cap 1. When "in-use" mode, this "spring-like" quality gives the rotating arm 4, with associated hearing protective earmuff 5, the ability to create a seal against users ear, thus providing effective sound attenuation. Said rotating arm 4 is provided with a mounting hole 4*a* (for cap 1 and flexible band 3 attachment) at one end of arm and a rotating arm adjustment slot 4*b* at the opposite end 17 of arm 4. The rotating arm adjustment slot 4*b* provides an adjustable means of providing attachment for the hearing protective earmuff 5, thus allowing flexibility with regards to individual fit requirements of the user.

Next a (fastener) concealment well 13 (with an associated cover cap 12—cover cap 12 "off" at this point) is placed over the extended portion of the binder post 15. In some embodiments concealment well 13 may be monolithic to design of rotating arm.

A inner teeth lock washer 16 (or the like dependent upon type of fastening system) is next placed over the extended portion of the binder post 15. A binder post screw 14 is next inserted into extended portion of binder post 15. Binder post screw 14 is next secured in place with proper torque so as to allow proper rotational tension of rotating arm 4. This is typical on each side of cap 1.

Upon proper application of torque to binder post screw 14, located within concealment well 13, the cover cap 12 is next seated in place. This is typical on each side of cap 1. The rotating arm 4 in conjunction with the concealment well, with cover cap 6, provides an aesthetically appealing means of concealing attachment of components to cap 1.

Figure 7:
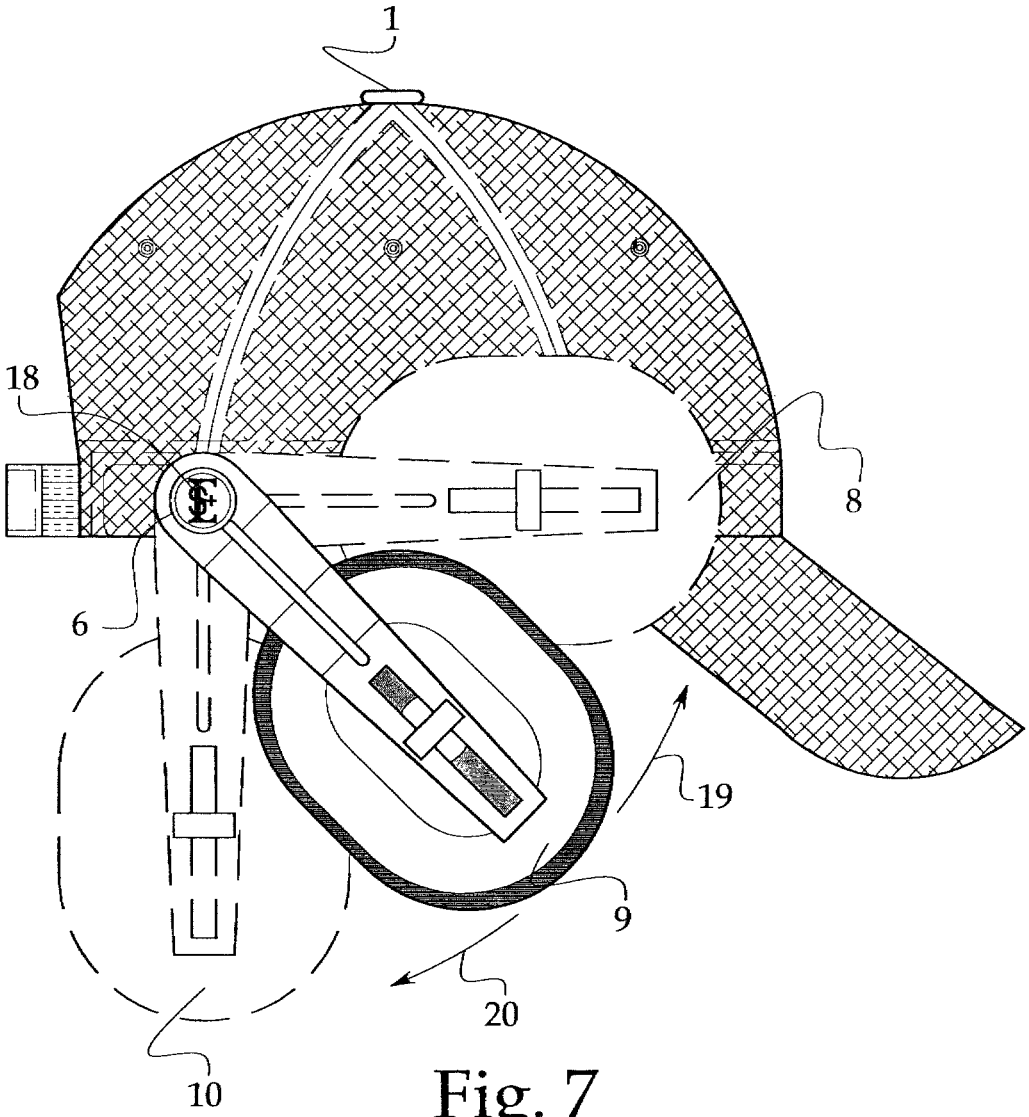
FIG. 7 is a left side view similar to FIG. 3, but illustrating transition of the exemplary cap hearing protection system to the usage position.
Figure 8:
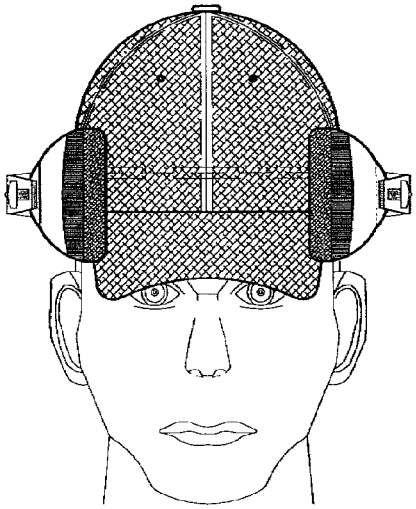
FIG. 8 is a front view similar to FIG. 1, but showing the exemplary cap hearing protection system as worn by a user and in the non-usage (or storage) position.
Figure 9:
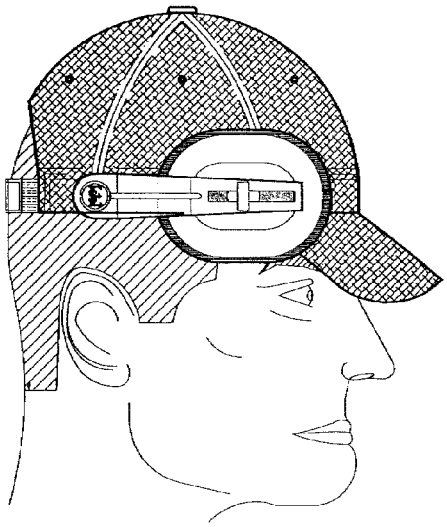
FIG. 9 is a left side view similar to FIG. 3, but showing the exemplary cap hearing protection system as worn by a user and in the non-usage (or storage) position.
Figure 16:
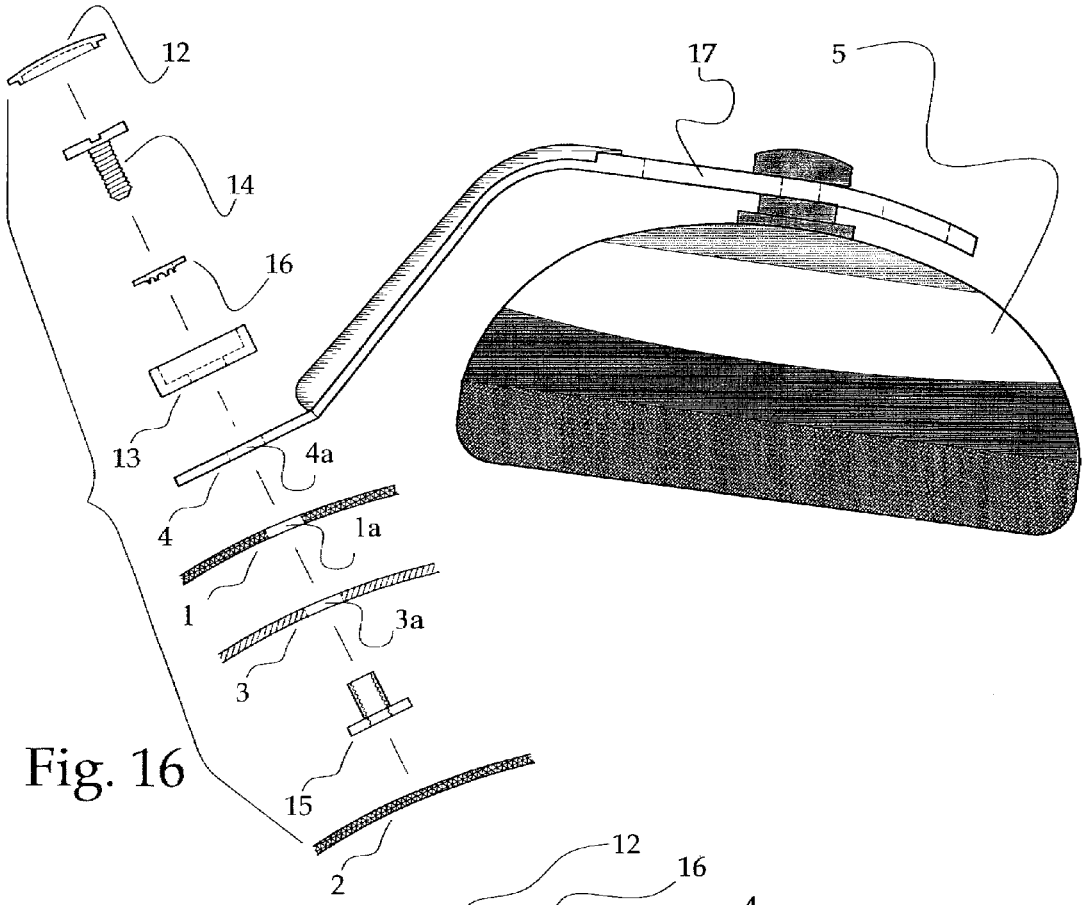
FIG. 16 is an exploded view of the components used to connect one of the rotating arms of the exemplary cap hearing protection system of FIG. 1 to the cap.
Figure 17:
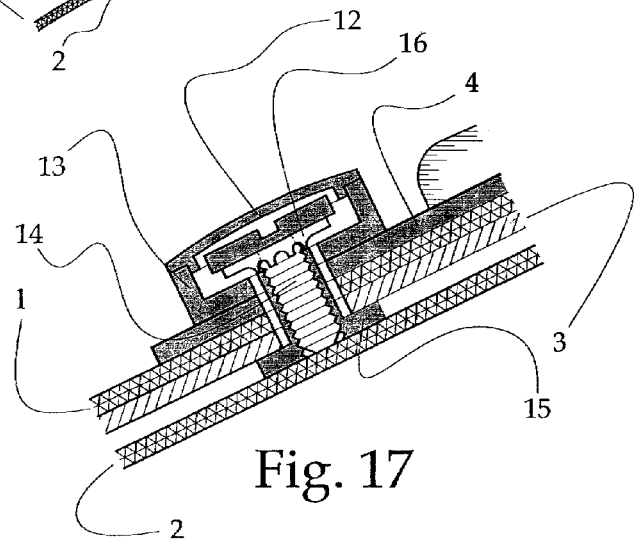
FIG. 17 is a cross-sectional view of the assembled components of FIG. 16.

Upon completion of assembly (to this point), a "pivot point for rotation of assembly" 18 has been created. "Pivot point": a binder post 15, is inserted thru the flexible band 3 (mounting platform), insertion of binder post 15 continues thru mounting hole 1*a* of the outer shell of cap 1, insertion of binder post 15 continues thru the mounting hole 4*a* of rotating arm 4, insertion of binder post 15 continues thru mounting hole of concealment well 13, insertion of binder post 15 continues thru the hole of inner teeth lock washer 16, with the assembly being secured into place with binder post screw 14 threaded into end of binder post 15, and concealed with cover cap 12. This system is typical on each side of cap 1. Said system comprising a "pivot point for rotation of assembly" 18. FIG. 16 depicts exploded view of the cap hearing protection system "pivot point area". FIG. 17 depicts cross sectional view of cap hearing protection system "pivot point area". FIG. 7 depicts the "pivoting system" in several states of usage: hearing protective earmuff in non-usage state 8, hearing protective earmuff direction of rotation to usage state 20, hearing protective earmuff in transition state 9, hearing protective earmuff in usage state 10, and hearing protective earmuff direction of rotation to non-usage state 19.

Hearing protective earmuffs 5: It is the full intention, of the cap hearing protection system, to possess the flexibility to attach a wide variety of hearing protective earmuffs 5 to the rotating arms 4. To accommodate this intention, appropriate custom provisions can be made regarding the means of hearing protective earmuff 5 attachment, along with rotating arm 4 configuration. An example of intended utilization includes, but is not limited to: basic passive hearing protection earmuffs (non electronic) 5—electronic hearing protection earmuffs 5—electronic hearing protection earmuffs with communication capabilities 5 and the like to mention a few. Considering the intended utilization of attachments, design flexibility is required to accommodate hearing protective earmuff 5 to rotating arm 4 fit up.

The hearing protective earmuff 5 is next placed against rotating arm adjustment slot 4*b* and secured to said slot with a fastening device. Specific ways to provide rotating arm 4 earmuff adjustment may vary due to intended wide range of intended usage of various hearing protective earmuffs 5. This is typical on each side of cap 1. The rotating arm adjustment slot 4*b* allows the user to strategically place the hearing protective earmuff 5 at an optimum position in reference to users ear, thus providing an effective muff-to-ear seal. To further provide an effective muff-to-ear seal, the means of muff attachment to rotating arm must also provide a degree of rotational ability. Both forms of flexibility are required to affect an optimum muff-to-ear seal.

Referring first to FIGS. 1-6, an exemplary cap hearing protection system made in accordance with the present invention is illustrated in the non-usage (or storage) position and comprises: a cap 1; a band 3 secured within the interior of the cap 1; first and second rotating arms 4 positioned on either side of the cap 1 and pivotally connected to the band 3; and a hearing protection means 5 mounted to each of the rotating arms 4.

Referring still to FIGS. 1-6, as mentioned above, the cap 1 can be any of a wide range of caps, including, for example, a common baseball or similarly billed cap. The cap 1 includes an exterior shell and an internal headband 2. The cap 1 is modified to provide a hole 1*a* (see FIG. 16) on either side of the cap 1. Such holes 1*a* penetrate the exterior shell of the cap 1, but do not penetrate the headband 2, the importance of which will be become clear in the discussion that follows. Such holes 1*a* may also be reinforced in some manner, for example, using thread or some form of insert.

The band 3 is secured within the interior of the cap 1, preferably within the existing headband 2 of the cap 1. For example, the headband 2 may be sewn over the band 3, thus encapsulating the band 3 within the headband 2 of the cap 1. The band 3 must have sufficient flexibility that can be manipulated to conform to the contours of a particular cap 1, but, at the same time, the band 3 must have sufficient rigidity to maintain its shape and serve as a mounting platform for the first and second rotating arms 4 and associated hearing protection means 5, as further discussed below. Accordingly, the band 3 is preferably made from a relatively thin metal (such as aluminum) or plastic, and, in some embodiments, has a width of approximately 0.75 inches.

Figures 12, 13:
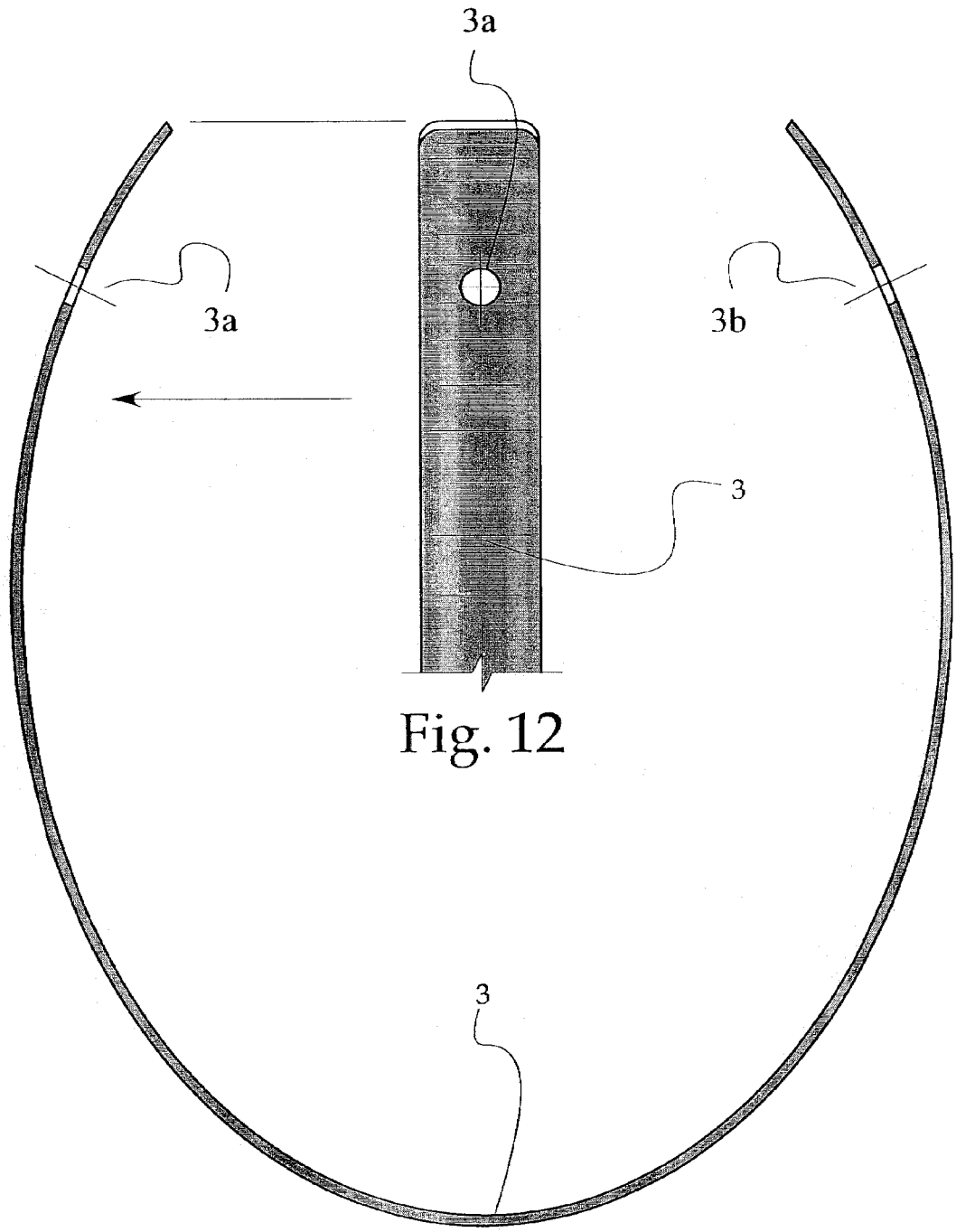
FIG. 12 is a partial elevation view of the band of the exemplary cap hearing protection system of FIG. 1.
FIG. 13 is a top view of the band of the exemplary cap hearing protection system of FIG. 1.

The band 3 extends around the periphery of the cap 1. In this exemplary embodiment, the band 3 begins and ends at the rear of the cap 1 on opposite sides of the adjustable band 7 at the rear of the cap 1. FIGS. 12 and 13 are further views of the band 3. As shown in FIGS. 12 and 13, the band 3 defines first and second mounting holes 3*a*, 3*b*, which correspond to the above-described holes 1*a* that penetrate the exterior shell of the cap 1.

As described above, the first and second rotating arms 4 are positioned on either side of the cap 1 and are pivotally connected to the band 3. Each of the rotating arms 4 is preferably made of a material that provides some "spring-like" characteristics, as further discussed below. For example, each of the rotating arms 4 may be made of a relatively thin metal or a preformed plastic. FIGS. 14*a* and 14*b* are further views of one of the rotating arms 4. As shown in FIGS. 14*a* and 14*b*, the rotating arm 4 can be characterized as having three sections: a first section that defines a hole 4*a* therethrough for facilitating the pivotal connection of the rotating arm 4 to the band 3, as further discussed below; a second or intermediate section that is oriented at an angle relative to the first section; and a third section that is oriented at an angle relative to the second section and defines a slot 4*b* therethrough for facilitating the mounting of the hearing protection means 5 to the rotating arm 4, as further discussed below.

Referring now to FIGS. 15*a-e*, which are views of the components used to connect one of the rotating arms 4 to the cap 1, along with the exploded and cross-sectional (assembled) views of FIGS. 16 and 17, a binder post 15 (or similar fastener) is introduced through the hole 3*a* or 3*b* defined by the band 3, with a flange portion of the binder post 15 abutting the surface of the band 3, while the shaft of the binder post 15 not only extends through the hole 3*a* defined by the band 3, but also extends through the hole 1*a* defined by the cap 1 and through the exterior shell of the cap 1. The shaft of the binder post 15 then further extends through the hole 4*a* defined through the first section of the rotating arm 4.

Referring still to FIGS. 15*a-e* and FIGS. 16-17, a concealment well 13 is then placed over the shaft of the binder post 15 and abuts the surface of the first section of the rotating arm 4. Indeed, in some embodiments, it is contemplated that such a concealment well 13 may be integral to the rotating arm 4 rather than a separate component. A binder post screw 14 is then inserted through a locking washer 16 and into the shaft of the binder post 15. The binder post screw 14 is screwed into the binder post 15 and secured in place with proper torque so that the rotating arm 4 can still pivot as intended, as further discussed below. Finally, a cover 12 is seated in place on top of the concealment well 13, covering and concealing the head of the binder post screw 14. In FIGS. 2-7, this assembly of components is generally indicated by reference numeral 6.

Figure 10:
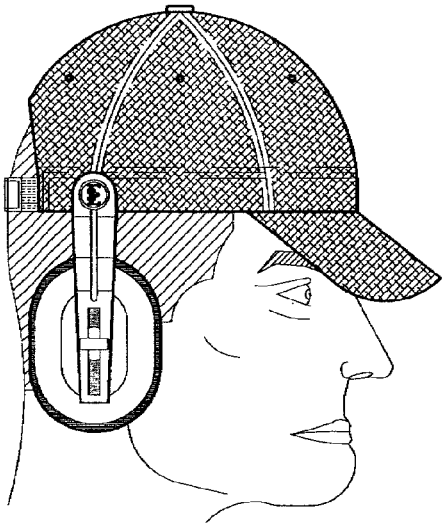
FIG. 10 is a left side view similar to FIG. 9, but showing the exemplary cap hearing protection system in the usage position.
Figure 11:
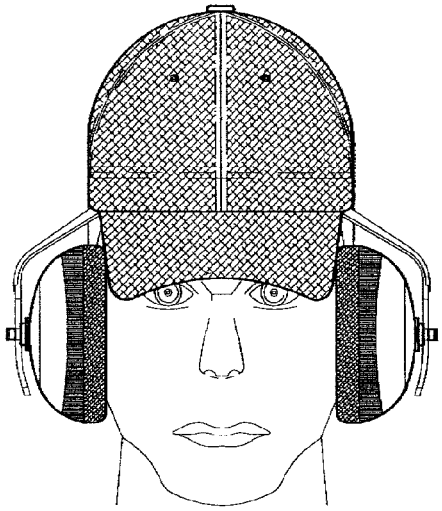
FIG. 11 is a front view similar to FIG. 8, but showing the exemplary cap hearing protection system in the usage position.

Referring now to FIGS. 7-11, as a result of the above-described assembly of components, each rotating arm 4 is pivotally connected to the band 3 and can rotate relative to the cap 1 about a pivot axis, A (FIG. 7), between a substantially horizontal non-usage (storage) position (FIGS. 8-9) and a substantially vertical usage position (FIGS. 10-11).

Lastly, a hearing protection means 5 is mounted to each of the rotating arms 4. As shown in FIGS. 1-11 and 16, in this exemplary embodiment, the hearing protection means 5 is in the form of a protective earmuff that is mounted to each of the rotating arms 4. However, other forms of hearing protection could also be mounted to each of the rotating arms 4 without departing from the spirit and scope of the present invention.

As best shown in FIG. 14*a*, in this exemplary embodiment, to facilitate the mounting of each protective earmuff 5 to the respective rotating arm 4, each of the rotating arms 4 defines a slot 4*b* therethrough which not only accommodates a fastener extending from a protective earmuff 5, but also allows for movement and repositioning of the protective earmuff 5 along the length of the slot 4*b* to ensure proper fit and positioning of the protective earmuffs 5 over the ears of a user in the usage position. Furthermore, since each of the rotating arms 4 is preferably made of a material that provides some "spring-like" characteristics, in the usage position the rotating arms 4 may be biased toward the ears of the user, thus providing a better seal against the ears and ensuring effective sound attenuation. At the same, the flexible and spring-like characteristics allow the rotating arms 4 to be flexed as they are rotated to the non-usage (storage) position, so that the protective earmuffs 5 can be positioned and stored against the sides of the cap 1.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A hearing protection system comprising:

a baseball cap, said baseball cap comprising a crown portion, said crown portion having an interior surface, an exterior surface, a front end, a rear end, a first side, a second side and a headband located at a lower region of the interior surface;

a flexible band positioned within the headband, said flexible band comprising a first end, positioned on the first side closer to the rear end than the front end, and extending around the front end of the crown portion to a second end, positioned on the second side closer to the rear end than the front end;

a first rotating arm comprising a first band end and a first muff end, said first rotating arm positioned on the first side of the crown portion and pivotally coupled at the first band end to the flexible band;

a second rotating arm comprising a second band end and a second muff end, said second rotating arm positioned on the second side of the crown and pivotally coupled at the second band end to the flexible band;

a first hearing protection muff having a first outer surface, said first muff end connected to the first outer surface, wherein the first rotating arm rotates between a substantially horizontal first non-usage position and a substantially vertical first usage position such that in the first usage position no portion of the first muff is in contact with the crown portion; and a second hearing protection muff having a second outer surface, said second muff end connected to the second outer surface, wherein the second rotating arm rotates between a substantially horizontal second non-usage position and a substantially vertical second usage position such that in the second usage position no portion of the second muff is in contact with the crown portion.

2. The cap hearing protection system of claim 1, wherein:

the first hearing protection muff is adjustably positioned in a direction between the first band end and the first muff end; and the second hearing protection muff is adjustably positioned in a direction between the second band end and the second muff end.

* * * * *